US009441623B2

(12) United States Patent
Ishii et al.

(10) Patent No.: US 9,441,623 B2
(45) Date of Patent: Sep. 13, 2016

(54) ELECTROMAGNETIC VIBRATING DIAPHRAGM PUMP

(75) Inventors: Hideki Ishii, Osaka (JP); Tsuyoshi Takamichi, Osaka (JP)

(73) Assignee: TECHNO TAKATSUKI CO., LTD., Osaka (JP)

( * ) Notice: Subject to any disclaimer, the term of this patent is extended or adjusted under 35 U.S.C. 154(b) by 306 days.

(21) Appl. No.: 14/117,540

(22) PCT Filed: May 2, 2012

(86) PCT No.: PCT/JP2012/061581

§ 371 (c)(1),
(2), (4) Date: Nov. 13, 2013

(87) PCT Pub. No.: WO2013/065344

PCT Pub. Date: May 10, 2013

(65) Prior Publication Data

US 2014/0271274 A1 Sep. 18, 2014

(30) Foreign Application Priority Data

Nov. 2, 2011 (JP) ..... 2011-241293

(51) Int. Cl.
*F04B 43/02* (2006.01)
*F04B 43/00* (2006.01)
(Continued)

(52) U.S. Cl.
CPC ..... *F04B 43/026* (2013.01); *F04B 43/0054* (2013.01); *F04B 43/04* (2013.01); *F04B 45/04* (2013.01); *F04B 45/043* (2013.01); *F04B 45/047* (2013.01)

(58) Field of Classification Search
CPC .. F04B 43/0054; F04B 43/026; F04B 43/04; F04B 45/04; F04B 45/043; F04B 45/047
See application file for complete search history.

(56) References Cited

U.S. PATENT DOCUMENTS 3,308,765 A * 3/1967 Mutschler ..... B60S 1/481 417/118
3,354,831 A * 11/1967 Acker ..... F04B 43/0054 417/387

FOREIGN PATENT DOCUMENTS

JP 2000130340 A 5/2000
JP 2000161232 6/2000
(Continued)

OTHER PUBLICATIONS

International Search Report, App PCT/JP2012/061581 dated Aug. 14, 2012.
(Continued)

*Primary Examiner* — Nathaniel Wiehe
*Assistant Examiner* — Logan Kraft
(74) *Attorney, Agent, or Firm* — Perman & Green, LLP

(57) ABSTRACT

An electromagnetic vibrating diaphragm pump enabling improvement of working efficiency in fitting center plates to a diaphragm, reduction of production cost and stabilization of performance between products. The disk-like second plate includes the cruciform rising portion having the concave portions, and the second ring rib. The first ring rib is formed at the center of the surface of the disk-like first plate coming into contact with the diaphragm, and a fitting groove provided with convex portions to be press-fitted to the concave portions is formed by this first ring rib. The diaphragm has the protrusions for preventing the diaphragm from being pressed out on the periphery of the through-hole at its center, and the protrusions are engaged with the ring ribs from the circumference of the protrusion.

2 Claims, 11 Drawing Sheets

(51) Int. Cl.

| | |
|---|---|
| ***F04B 43/04*** | (2006.01) |
| ***F04B 45/04*** | (2006.01) |
| ***F04B 45/047*** | (2006.01) |

(56) References Cited

FOREIGN PATENT DOCUMENTS

| | | |
|---|---|---|
| JP | 2000170661 | 6/2000 |
| JP | 2005220769 A | 8/2005 |
| JP | 2008150959 A | 7/2008 |
| JP | 2009178981 A | 8/2009 |

OTHER PUBLICATIONS

Written Opinion, App PCT/JP2012/061581 dated Aug. 14, 2012.

* cited by examiner (a)

(b)

(c)

(a)

(b)

(c)

ELECTROMAGNETIC VIBRATING DIAPHRAGM PUMP

CROSS-REFERENCE TO RELATED APPLICATIONS

This application is the National Stage of International Application No. PCT/JP2012/061581 with an International Filing date, 2 May 2012, which designated the United States of America, and which International Application was published under PCT Article 21 (s) as WO Publication 2013/065344 A1 and which claims priority from, and the benefit of, Japanese Application No. 2011-241293 filed 2 Nov. 2011, the disclosures of which are incorporated herein by reference in their entireties.

BACKGROUND

The presently disclosed embodiment relates to an electromagnetic vibrating diaphragm pump to be used for aeration of a domestic septic tank, oxygen supply to a fish tank, air blow of a bubbling bath and other applied apparatuses.

An electromagnetic vibrating diaphragm pump undergoes suction and discharging of a fluid by driving diaphragms by carrying out reciprocating vibration of an oscillator having permanent magnets and connected to the diaphragms using a magnetic co-action with one electromagnet or with two electromagnets provided so as to locate the oscillator therebetween. The diaphragms are sandwiched between center plates comprising a pair of disc-like plates and are fixed to the oscillator via the center plates.

For fixing the diaphragm with the center plates, for example, there is a method of laying a disc-like diaphragm on the outer side of the disc-like center plate and subjecting a contact portion of the center plate and the diaphragm to welding with ultrasonic wave to fix them as disclosed in JP 2009-178981 A. Such a fixing method by ultrasonic welding is explained in detail by referring to FIG. 7. In addition, FIG. 8 shows a front view in the direction of M of FIG. 7, FIG. 9 shows a C-C cross-section of FIG. 8, and FIG. 10 shows a front view in the direction of N of FIG. 7.

FIG. 7 shows a disc-like diaphragm 104 and first and second plates 107*a* and 107*b* constituting the center plates for sandwiching the diaphragm 104. The first plate 107*a* is in the form of a disc having a through-hole H1 formed at its center, and has a receiving concave portion 133 for receiving a cylindrical portion 127 of the second plate 107*b* explained below as shown in FIGS. 11*a* and 11*b*. The second plate 107*b* is in the form of a disc having a through-hole H2 formed at its center, and comprises the cylindrical portion 127 formed at its center, a groove 128 formed along an outer periphery of the cylindrical portion 127, four holes 129 formed in the circumferential direction of the groove 128 at an interval of 90°, and a ring rib 132 formed at the external side in a radial direction of the holes 129 and pressing the surface of the diaphragm 104. Further, as shown in FIG. 10, at the second plate 107*b* side of the diaphragm 104, a raised ring portion 130 is provided at the external side in a radial direction of the through-hole 126 formed at the center of the diaphragm along the through-hole 126, and four protruded portions 131 extending from the outer periphery of the raised portion 130 at an interval of 90° in the circumferential direction of the raised portion 130 are provided.

When the diaphragm 104 and the first and second plates 107*a* and 107*b* constituting the center plates are in the shape shown in FIG. 7, the second plate 107*b* is assembled to the diaphragm 104 in such a manner that the cylindrical portion 127 of the second plate 107*b* is inserted through the through-hole 126 of the diaphragm 104, the raised portion 130 of the diaphragm 104 (see FIG. 10) is fitted into the groove 128 of the second plate 107*b*, and the protruded portions 131 of the diaphragm 104 (see FIG. 10) are fitted into the holes 129 of the second plate 107*b*. Further, the first plate 107*a* is assembled to the diaphragm 104 by ultrasonic welding of the first plate 107*a* and the cylindrical portion 127 of the second plate 107*b* protruded toward the first plate 107*a* side.

This ultrasonic welding is explained by means of FIGS. 11*a* and 11*b*. As shown in FIG. 11*a*, the bottom portion of the cylindrical portion 127 of the second plate 107*b* is tapered, and the corner of the receiving concave portion 133 of the first plate 107*a* is pressed onto this bottom portion and ultrasonic wave is applied to this pressed portion for welding (portions to be welded in the drawing). Thereby, as shown in FIG. 11*b*, a tapered meltable portion which is the bottom portion of the second plate 107*b* is melted (shown by a dotted pattern in the drawing), and is filled in a gap between the cylindrical portion 127 of the second plate 107*b* and the receiving concave portion 133. Thus, the first plate 107*a* can be assembled to the second plate 107*b*.

SUMMARY

However, when assembling center plates to a diaphragm by ultrasonic welding like the example of prior art disclosed in JP 2009-178981 A and FIG. 7, there is a problem that a positional relation between the first plate 107*a* and the second plate 107*b* is not fixed when assembling and there arises a difference in a assembled state of the center plates (the first plate 107*a* and the second plate 107*b*) to the diaphragm 104 and welded condition between products, which makes performance of diaphragm pumps unstable in each of products, though this depends on molded condition of the meltable portion and a method of assembling the first plate 107*a* and the second plate 107*b* constituting the center plates before the ultrasonic welding, or other factors. Further, there is a problem that since equipment for ultrasonic welding is required separately, production cost is increased and that since an additional step of ultrasonic welding is necessary, work efficiency at production of diaphragm pumps is lowered.

In addition, when assembling the center plates (the first plate 107*a* and the second plate 107*b*) to the diaphragm 104 by welding as shown in FIG. 7, the cylindrical portion 127 of the second plate 107*b* of the center plates is inserted into the through-hole 126 of the diaphragm 104. However, there is a problem that at the time of assembling work, the first plate 107*a* and the second plate 107*b* easily rotate with respect to the diaphragm 104, thereby making positioning thereof difficult and causing a problem with working efficiency at the time of assembling the center plates (the first plate 107*a* and the second plate 107*b*) to the diaphragm 104. Further, in the method of assembling shown in FIG. 7, when the protruded portions 131 (see FIG. 10) provided on the surface of the diaphragm 104 coming into contact with the second plate 107*b* are fitted into the holes 129 (see FIG. 7) provided on the surface of the second plate 107*b* of the center plates coming into contact with the diaphragm 104, a contact surface area between the diaphragm 104 and the center plate is not sufficient, and it is difficult to secure a sufficient holding power for keeping the assembled state of the first and second plates 107*a* and 107*b* constituting the center plates to the diaphragm 104. Therefore, the first and second plates 107*a* and 107*b* easily come off from the through-hole 126 of the diaphragm 104 and are separated from the diaphragm 104.

Furthermore, since the first plate 107*a* is assembled to the diaphragm 104 only by welding of the cylindrical portion 127 of the second plate 107*b*, there is a problem that when a pump is operated, a rubber of the diaphragm 104 gets over the ring rib 132, formed at the external side in a radial direction from the groove 128, of the second plate 107*b* and is pressed out. As a result, there arises a difference in a force of holding the diaphragm 104 with the first and second plates 107*a* and 107*b* constituting the center plates between products, thereby making it difficult to make uniform a reference center position of oscillation of the oscillator during operating of a pump (a center position in the oscillation direction of the oscillator) between products and stabilize performance of produced pumps.

The presently disclosed embodiment has been made in light of the above-mentioned circumstances, and an object of the presently disclosed embodiment is to provide an electromagnetic vibrating diaphragm pump enabling improvement of work efficiency in assembling center plates to a diaphragm, reduction of production cost and stabilization of performance between products.

The electromagnetic vibrating diaphragm pump of the presently disclosed embodiment is an electromagnetic vibrating diaphragm pump for suction and discharging of a fluid by carrying out reciprocating vibration of an oscillator using a magnetic action and driving a pair of disc-like diaphragms provided at both ends of the oscillator, in which each of the disc-like diaphragms is sandwiched from both sides thereof by center plates comprising a pair of disc-like plates, the center plates comprise a first plate having a plurality of convex portions formed on its surface coming into contact with the diaphragm and a second plate arranged opposite to the first plate and having a plurality of concave portions into which the convex portions are press-fitted, the convex portions of the first plate are press-fitted to the concave portions of the second plate through an opening formed at the center of the diaphragm, disc-like protrusions for preventing the diaphragm from being pressed out which protrude from both surfaces of the diaphragm are formed on the periphery of the opening of the diaphragm, and ring ribs engaging with the protrusions for preventing the diaphragm from being pressed out from the outer side in a radial direction of the diaphragm are formed on the first plate and the second plate, respectively.

Further, it is preferable that in the electromagnetic vibrating diaphragm pump of the presently disclosed embodiment, the first plate comprises a fitting groove for fitting the protrusion for preventing the diaphragm from being pressed out, the second plate comprises a fitting groove for fitting the protrusion for preventing the diaphragm from being pressed out, among the ring ribs, a first ring rib of the first plate side is formed so as to be raised along a margin of the fitting groove and is protruded higher than the surface of the first plate extending from the first ring rib outward in a radial direction of the plate, and among the ring ribs, a second ring rib of the second plate side is formed so as to be raised along a margin of the fitting groove and is protruded higher than the surface of the second plate extending from the second ring rib outward in a radial direction of the plate.

Furthermore, it is preferable that in the electromagnetic vibrating diaphragm pump of the presently disclosed embodiment, rotation-preventing protruded portions for preventing the center plates from rotating with respect to the diaphragm are formed on the edge of the opening of the diaphragm, in which the protruded portions are protruded toward the inner side in a radial direction of the diaphragm, and a rising portion extending in a vertical direction from the surface of the first plate or the second plate coming into contact with the diaphragm and having a shape corresponding to the opening having the rotation-preventing protruded portions formed thereon is formed on the first plate or the second plate, in which the rising portion is engaged with the rotation-preventing protruded portions.

As mentioned above, according to the electromagnetic vibrating diaphragm pump of the presently disclosed embodiment, center plates are assembled to the diaphragm by fitting the convex portions into the concave portions of a pair of plates constituting the center plates. Therefore, the presently disclosed embodiment is free of a problem arising in conventional ultrasonic welding, that is to say, a problem that a positional relation between one plate and another plate when assembling them and before conducting the ultrasonic welding is not fixed due to the molding condition of the portion to be welded and the method of assembling one plate to another plate constituting the center plates, or other factors, thereby causing a difference in a assembled state and welded condition between the diaphragm and the center plate in each of products. Thus, performance of produced diaphragm pumps is made stable. Further, a conventional step of ultrasonic welding is unnecessary when assembling the center plates to the diaphragm. Therefore, work efficiency when assembling the center plates to the diaphragm is improved. Furthermore, since equipment for welding is not required, production cost of the pump can be reduced. And, since the ring ribs formed on the first plate and the second plate are engaged, from the outer side in a radial direction of the diaphragm, with the disk-like protrusions for preventing the diaphragm from being pressed out which are formed on the periphery of the opening of the diaphragm and protrude from the both surfaces of the diaphragm, no gap is produced between the ring rib and the protrusions for preventing the diaphragm from being pressed out, thereby making it possible to prevent the rubber of the diaphragm from being pressed out due to repeated use of a pump and prevent the diaphragm from being deformed. As a result, it is possible to make uniform a reference center position of oscillation of the oscillator (a center position in the oscillation direction of the oscillator) between products and stabilize performance of produced pumps during operating a pump.

Further, the first plate comprises a fitting groove for fitting the protrusion for preventing the diaphragm from being pressed out, the second plate comprises a fitting groove for fitting the protrusion for preventing the diaphragm from being pressed out, among the ring ribs, a first ring rib of the first plate side is formed so as to be raised along the margin of the fitting groove and is protruded higher than the surface of the first plate extending from the first ring rib outward in a radial direction of the plate, and among the ring ribs, a second ring rib of the second plate side is formed so as to be raised along the margin of the fitting groove and is protruded higher than the surface of the second plate extending from the second ring rib outward in a radial direction of the plate. In this case, the contacting area between the protrusion for preventing the diaphragm from being pressed out and the ring rib in a radial direction (a direction of vibration of the oscillator) is increased, and thereby, in a diaphragm, a contact pressure between the first and second plates and the surfaces of the diaphragm at the external sides close to the protrusion for preventing the diaphragm from being pressed out in a radial direction of the diaphragm is higher than that of conventional diaphragm. As a result, pressing out of a rubber of the diaphragm can be prevented surely and deformation of the diaphragm can be prevented as compared with conventional diaphragm, and in addition, it is possible to make uniform a reference center position of oscillation of the oscillator during running of a pump between products and stabilize performance of produced pumps surely.

Further, the rotation-preventing protruded portions which are formed on the edge of the opening of the diaphragm and are protruded toward the inner side in a radial direction of the diaphragm are engaged with the rising portion which extends in a vertical direction from the surface of the first plate or the second plate coming into contact with the diaphragm and has a shape corresponding to the opening having the rotation-preventing protruded portions formed thereon, and therefore, when setting the center plates to the diaphragm, the first and second plates and constituting the center plates are in position to the diaphragm and hardly rotate, thereby increasing work efficiency in setting the center plates to the diaphragm.

DETAILED DESCRIPTION

The electromagnetic vibrating diaphragm pump of the presently disclosed embodiment is explained below by referring to FIG. 1 to FIG. 6.

Figure 1:
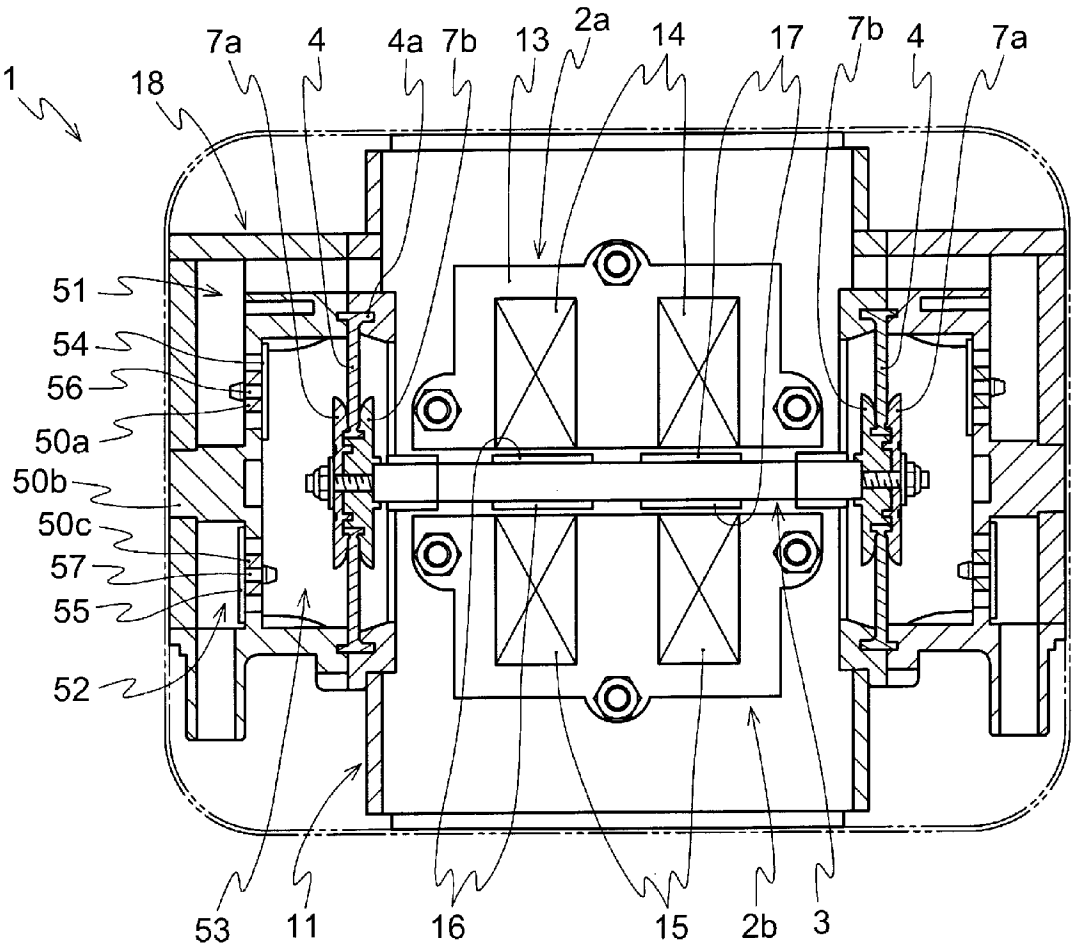
FIG. 1 is a cross-sectional view of the electromagnetic vibrating diaphragm pump of the presently disclosed embodiment.

FIG. 1 shows the electromagnetic vibrating diaphragm pump of the presently disclosed embodiment according to a first aspect. The main parts of this electromagnetic vibrating diaphragm pump 1 (hereinafter simply referred to as pump 1) comprise a casing 11 for electromagnet, a pair of electromagnets 2*a* and 2*b* arranged inside a casing 11 for electromagnet, an oscillator 3 arranged between the electromagnets 2*a* and 2*b* without being contact with the electromagnets 2*a* and 2*b*, a pair of disc-like diaphragms 4 arranged at both ends of the oscillator 3 and center plates comprising a pair of disk-like plates (first plate 7*a* and second plate 7*b*) for sandwiching and fixing the diaphragm 4. The diaphragm 4 can be made by molding an ethylene propylene rubber (EPDM), a fluorine-containing rubber or the like, and a material of the diaphragm is not limited particularly as long as it is a material enabling elastic deformation following the movement of the oscillator 3. The first plate 7*a* and the second plate 7*b* can be a member being hard to such an extent to enable the both to be combined as explained below, and can be made by molding plastic such as PBT (polybutylene terephthalate), for example.

The electromagnets 2*a* and 2*b* comprise an E-shaped electromagnetic core 13 and electromagnetic coils 14 and 15 incorporated in the electromagnetic core 13. Permanent magnets 16 (for example N-pole) and permanent magnets 17 (for example S-pole) having different polarity with each other are arranged on the portions of the oscillator 3 facing the electromagnetic coils 14 and 15. The diaphragm 4 has a flange portion 4*a* on its outer periphery, and this flange portion 4*a* is fixed with the casing 11 for electromagnet and a pump casing 18. Further, the oscillator 3 is fixed to the second plate 7*b*.

The pump casing 18 is separated into a suction chamber 51, a discharge chamber 52 and a compression chamber 53 having the diaphragm 4 arranged thereto, by three partition walls 50*a*, 50*b* and 50*c*. On the partition wall 50*a*, a suction valve 54 is mounted from the compression chamber 53 side. By opening this suction valve 54, a fluid such as air is drawn into the compression chamber 53 through a vent hole 56 formed on the partition wall 50*a*. On the partition wall 50*c*, a discharge valve 55 is mounted from the discharge chamber 52 side. By opening this discharge valve 55, air in the compression chamber 53 is discharged into the discharge chamber 52 through a vent hole 57 formed on the partition wall 50*c*.

Figure 2:
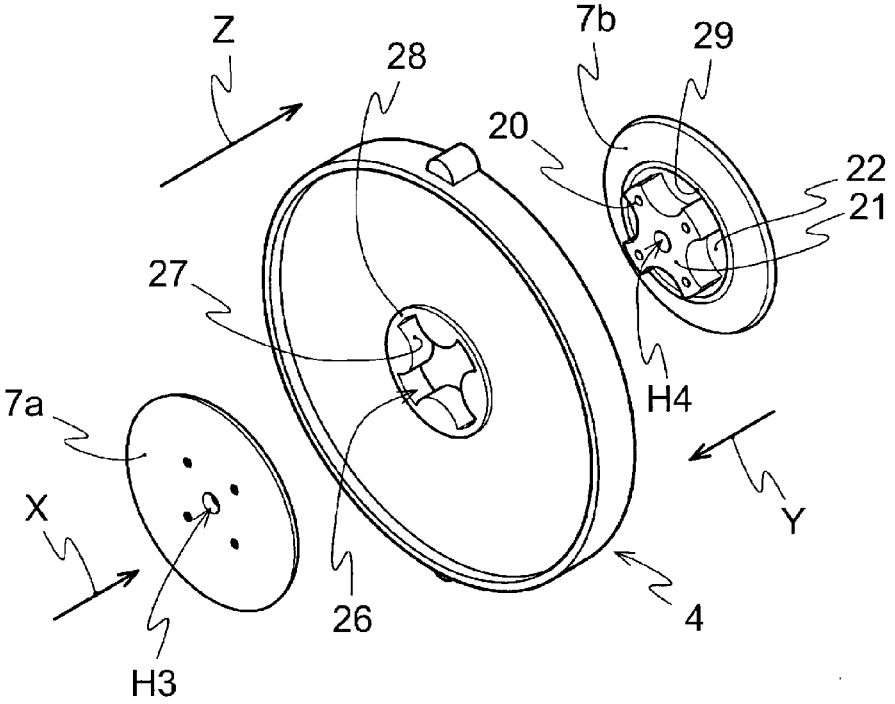
FIG. 2 is a perspective view for explaining a step of assembling the center plates to the diaphragm in the diaphragm pump shown in FIG. 1.

Next, assembling of the diaphragm 4 and the center plates (the first plate 7*a* and the second plate 7*b*) shown in FIG. 1 is explained by referring to FIG. 2 to FIG. 6. The second plate 7*b* is in the disc-like form having a rising center portion and a through-hole H4 formed at its center. The second plate 7*b* comprises a cruciform rising portion 21 extending in a vertical direction toward the diaphragm 4 from its center of the contacting surface with the diaphragm 4 and inserted into the through-hole 26 provided at the center of the diaphragm 4 explained below, a second ring rib 29 to be assembled to the diaphragm 4, which is formed at the external side in the radial direction from the rising portion 21, and a fitting groove 22 which is formed by the second ring rib 29 and the rising portion 21 and is used for fitting, thereinto, protrusion 28 for preventing the diaphragm from being pressed out as explained below. The second ring rib 29 is formed separated from the rising portion 21 outside in a radial direction of the center plate. As shown in FIGS. 2, 4*a* and 4*b*, the second ring rib 29 is formed so as to be raised along the margin of the fitting grooves 22 and protruded higher than the surface of the second plate 7*b* extending from the second ring rib 29 outward in a radial direction of the plate (See FIGS. 4*a* and 4*b*). The fitting groove 22 is a concaved portion between the inner peripheral edge of the second ring rib 29 and the outer peripheral edge of the rising portion 21. The rising portion 21 has four arms extending from the center of the second plate 7*b*, and concave portions 20 for assembling to the first plate 7*a* are formed on the free end sides of the respective arms.

Figure 4A:
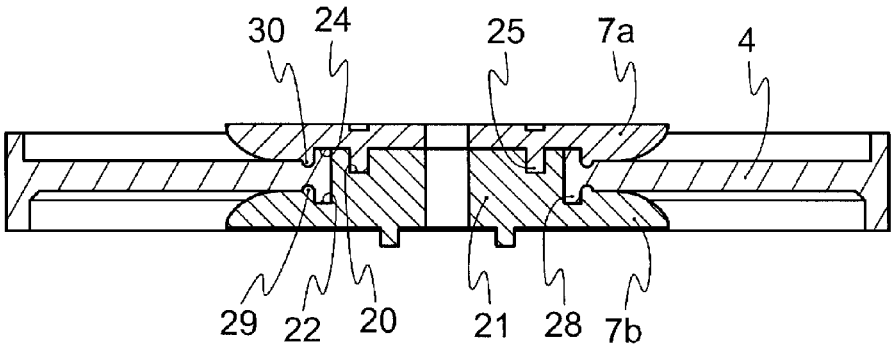
FIG. 4*a* is an A-A line cross-sectional view of FIG. 3.
Figure 4B:
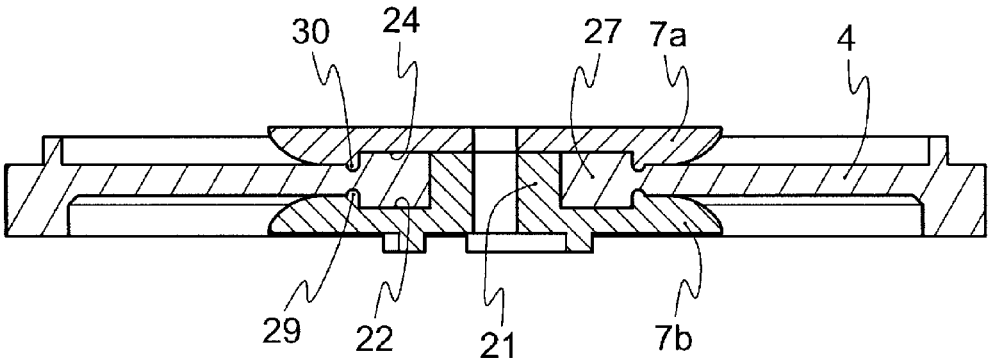
FIG. 4*b* is a B-B line cross-sectional view of FIG. 3.
Figure 6:
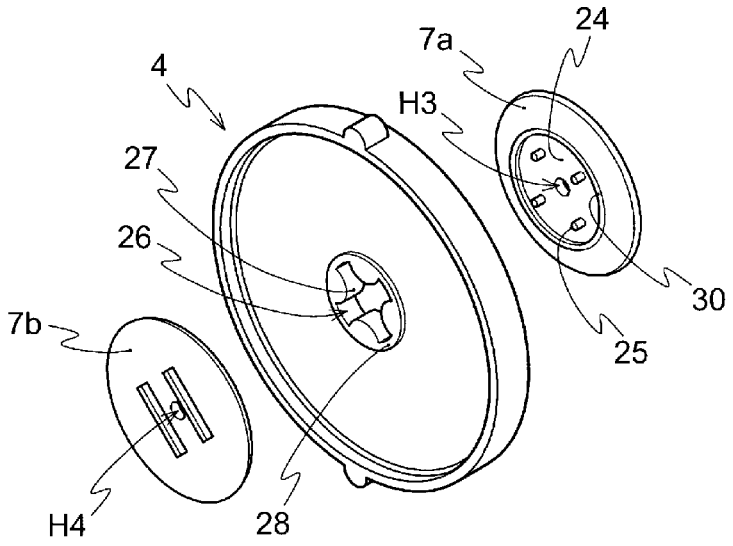
FIG. 6 is a perspective view from the opposite side of FIG. 2.

As shown in FIG. 6, the first plate 7*a* is in a disc-like form having a recessed center portion and a through-hole H3 formed at its center. A first ring rib 30 for assembling to the diaphragm 4 extending in a vertical direction toward the diaphragm 4 side is formed at the center of the contacting surface of the first plate with the diaphragm 4. By this first ring rib 30, a fitting groove 24 for fitting the protrusion 28 for preventing the diaphragm from being pressed out is formed as explained below. In this fitting groove 24, convex portions 25 which have a shape corresponding to the shape of the concave portions 20 of the second plate 7*b* and are press-fitted into these concave portions 20 are formed in the circumferential direction of the fitting groove 24 at an interval of 90°. As shown in FIGS. 4*a*, 4*b* and 6, the first ring rib 30 is formed so as to be raised along the margin of the fitting groove 24 and protruded higher than the surface of the first plate 7*a* extending from the first ring rib 30 outward in a radial direction of the plate (See FIGS. 4*a* and 4*b*). The shape of the convex portions 25 is not limited particularly as long as they can be fitted to the concave portions 20, and similarly, the shape of the concave portions 20 is not limited.

Figure 3:
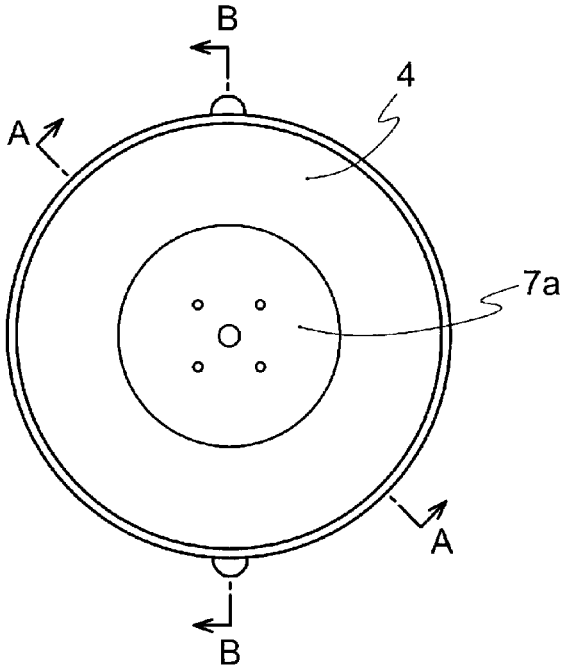
FIG. 3 is a front view in the direction of X of FIG. 2.
Figure 5:
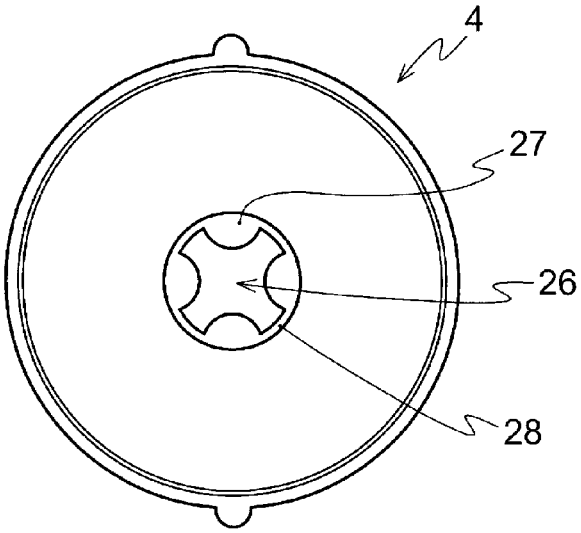
FIG. 5 is a front view of the diaphragm in the direction of Y of FIG. 2.

As shown in FIG. 2, the through-hole 26 (opening) is formed at the center of the diaphragm 4, and rotation preventing protruded portions 27 protruding inward in the radial direction of the diaphragm 4 are formed on the edge of the opening of the through-hole 26. The opening has a cruciform shape corresponding to the shape of the rising portion 21 of the second plate 7*b* constituting the center plates. Further, on the periphery of the through-hole 26, the diaphragm 4 has the protrusions 28 for preventing the diaphragm from being pressed out which are protruded from the both surfaces of the diaphragm 4 and are integrated with the rotation preventing protruded portions 27. The front view in the direction of X of FIG. 2 is shown in FIG. 3, an A-A line cross-sectional view of FIG. 3 is shown in FIG. 4*a*, a B-B line cross-sectional view of FIG. 3 is shown in FIG. 4*b*, and a front view in the direction of Y of FIG. 2 is shown in FIG. 5.

The first and second plates 7*a* and 7*b* constituting the center plates are assembled to the diaphragm 104, for example, by superposing the diaphragm 4 and the first plate 7*a* in order on the second plate 7*b* in the direction of an arrow Z as shown in FIG. 2. The details of the assembling are such that firstly, the rising portion 21 of the second plate 7*b* is inserted through the through-hole 26 of the diaphragm 4. By this, the ring rib 29 of the second plate 7*b* is engaged with the protrusion 28 for preventing the diaphragm from being pressed out from the circumference of the protrusion 28, and the protrusion 28 of the diaphragm 4 for preventing the diaphragm from being pressed out are fitted to the fitting groove 22 of the second plate 7*b*. By the works made up to this point, the second plate 7*b* has been assembled to the diaphragm 4, and the edge face of the rising portion 21 is in plane with the edge face of the protrusion 28 of the diaphragm 4 for preventing the diaphragm from being pressed out at the first plate 7*a* side. Next, the convex portions 25 of the first plate 7*a* are fitted to the concave portions 20 formed on the rising portion 21 of the second plate 7*b* by press-fitting, and the ring rib 30 (FIG. 6) of the first plate 7*a* is engaged with the protrusion 28 for preventing the diaphragm from being pressed out from the circumference of the protrusion 28 for preventing the diaphragm from being pressed out. By this, the protrusion 28 of the diaphragm 4 for preventing the diaphragm from being pressed out are fitted to the fitting groove 24 (FIG. 6) on the surface of the first plate 7*a* coming into contact with the diaphragm 4. By the works mentioned above, the assembling of the first and second plates 7*a* and 7*b* constituting the center plates to the diaphragm 4 is completed.

As mentioned above, in the electromagnetic vibrating diaphragm pump 1 of this aspect, the first plate 7*a* and the second plate 7*b* are assembled to the diaphragm 4 by press-fitting the convex portions 25 of the first plate 7*a* as one constituting the center plates to the concave portions 20 of the second plate 7*b* as another one constituting the center plates. Therefore, this aspect is free of a problem arising in conventional ultrasonic welding, that is to say, a problem that a positional relation between the first plate 7*a* and the second plate 7*b* when assembling them and before conducting the ultrasonic welding is not fixed due to the method of assembling the second plate 7*b* to the first plate 7*a* constituting the center plates, or other factors, thereby causing a difference in a assembled state and welded condition between the diaphragm 4 and the center plate in each products. Thus, performance of produced diaphragm pumps is made stable. Further, a conventional step of ultrasonic welding is unnecessary when assembling the first plate 7*a* and the second plate 7*b* to the diaphragm 4. Therefore, work efficiency when assembling the first plate 7*a* and the second plate 7*b* to the diaphragm 4 is improved. Furthermore, since equipment for welding is not required, production cost of the pump 1 can be reduced.

In the case of the aspect of the presently disclosed embodiment shown in FIG. 2, the ring ribs 29 and 30 of the first and second plates 7*a* and 7*b* constituting the center plates are engaged with the protrusions 28 for preventing the diaphragm from being pressed out, which are formed on both surfaces of the diaphragm 4, from the circumference of the protrusions 28 for preventing the diaphragm from being pressed out. Therefore, there arises no gap between the ring ribs 29 and 30 and the protrusions 28 for preventing the diaphragm from being pressed out, and during operating of the pump 1, a rubber of the diaphragm 4 hardly gets over the ring ribs 29 and 30 and moves outward. Further since the rubber of the diaphragm 4 is prevented from being pressed out by the protrusions 28 and the ring ribs 29 and 30 even in the case of repeated use of the pump 1, deformation of the diaphragm 4 can be prevented. As a result, a reference center position of oscillation of the oscillator 3 (a center position in the oscillation direction of the oscillator 3) can be made uniform between products and performance of the pump 1 can be stabilized in each of products during operating the pump 1. Further, the first plate 7*a* is provided with the fitting groove 24 for fitting thereto the protrusions 28 for preventing the diaphragm from being pressed out, the second plate 7*b* is provided with the fitting groove 22 for fitting thereto the protrusions 28 for preventing the diaphragm from being pressed out, among the ring ribs 29 and 30, the first ring rib 30 formed on the first plate 7*a* side is formed so as to be raised along the margin of the fitting groove 24 and is protruded higher than the surface of the first plate 7*a* extending from the first ring rib 30 outward in a radial direction of the plate, and among the ring ribs 29 and 30, the second ring rib 29 formed on the second plate 7*b* side is formed so as to be raised along the margin of the fitting groove 22 and is protruded higher than the surface of the second plate 7*b* extending from the second ring rib 29 outward in a radial direction of the plate. In this case, a contact area between the protrusion 28 for preventing the diaphragm from being pressed out and the first and second ring ribs 29 and 30 in the radial direction (the oscillation direction of the oscillator) is large, and thereby, in the diaphragm 4, the pressure of the contact surface between the surface of the diaphragm 4 extending outward in its radial direction and being close to the protrusion 28 for preventing the diaphragm from being pressed out and the first and second plates 7*a* and 7*b* is higher than that of conventional diaphragms. As a result, a rubber of the diaphragm 4 can be prevented surely from being pressed out as compared with conventional diaphragms and deformation of the diaphragm 4 can be prevented, and in its turn, a reference center position of oscillation of the oscillator 3 during operating the pump 1 can be made uniform between products and performance of the pump 1 can be stabilized surely in each of products.

The outer diameter of the protrusion 28 for preventing the diaphragm from being pressed out is not limited particularly as long as the ring ribs 29 and 30 of the first and second plates 7*a* and 7*b* constituting the center plates can be engaged with the protrusion 28 for preventing the diaphragm from being pressed out from the circumference of the protrusion 28 for preventing the diaphragm from being pressed out and the sufficient contact surface area between the diaphragm 4 and the first and second plates 7*a* and 7*b* constituting the center plates can be secured.

Figure 7:
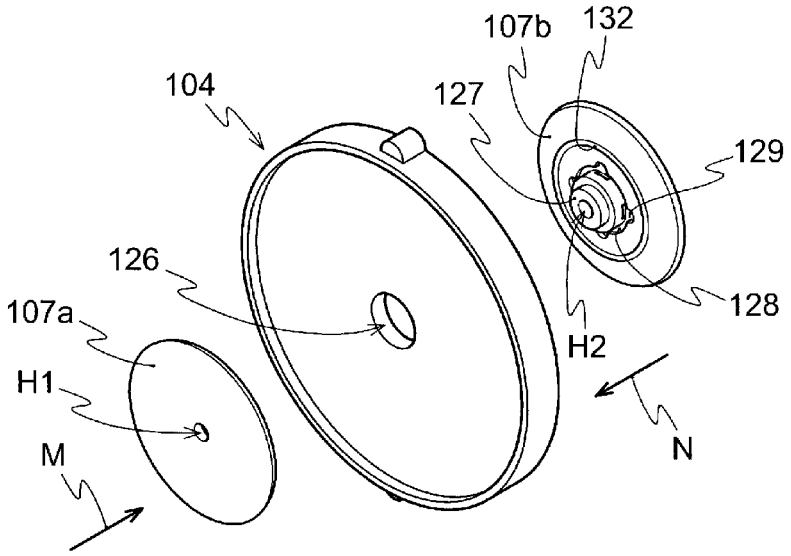
FIG. 7 is a perspective view of a diaphragm and center plates of a conventional electromagnetic vibrating diaphragm pump for explaining a step of assembling thereof.
Figure 8:
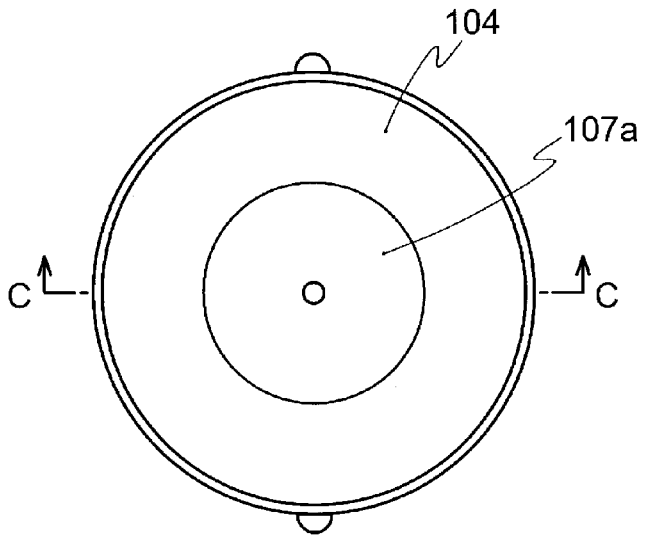
FIG. 8 is a front view in the direction of M of FIG. 7.
Figure 9:
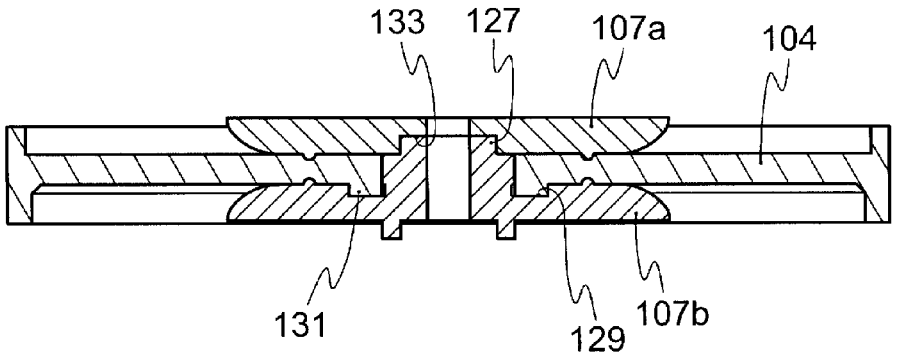
FIG. 9 is a C-C line cross-sectional view of FIG. 8.
Figure 10:
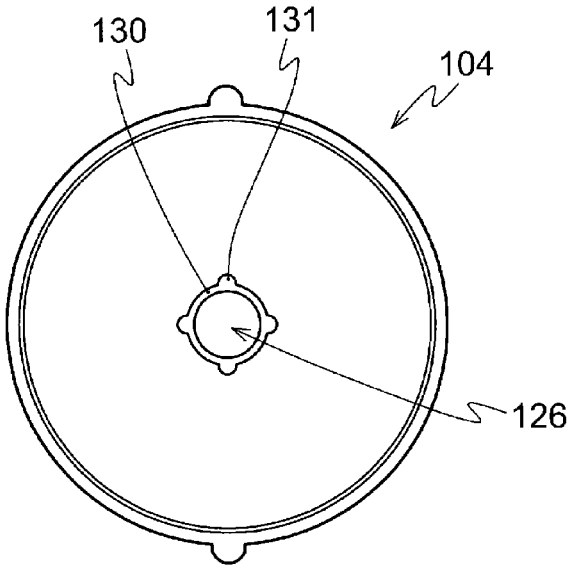
FIG. 10 is a front view of the diaphragm in the direction of N of FIG. 7.
Figure 11A:
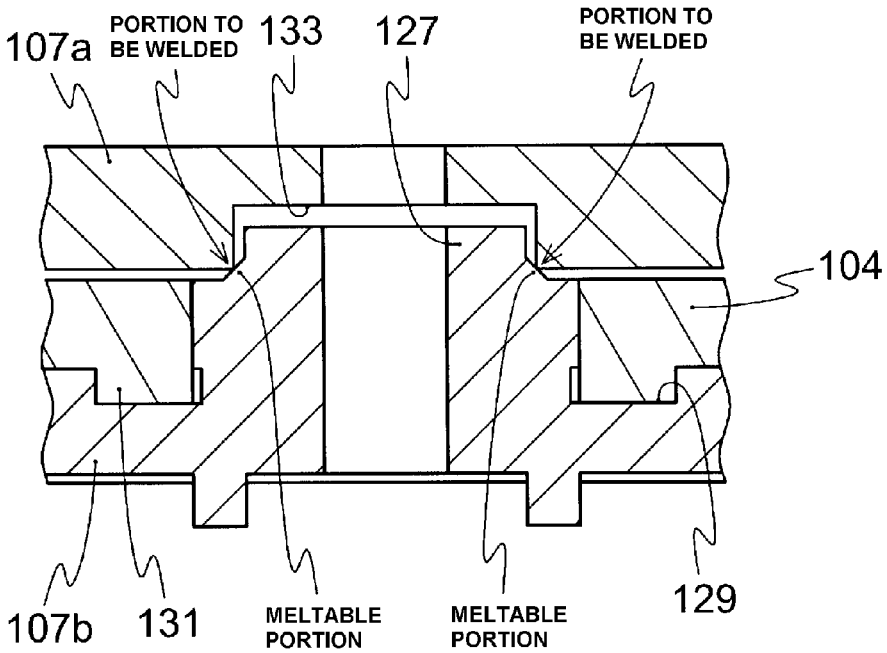
FIG. 11*a* is a cross-sectional view showing a conventional method of fitting center plates to a diaphragm for explaining one step of fitting the center plates to the diaphragm by ultrasonic welding.
Figure 11B:
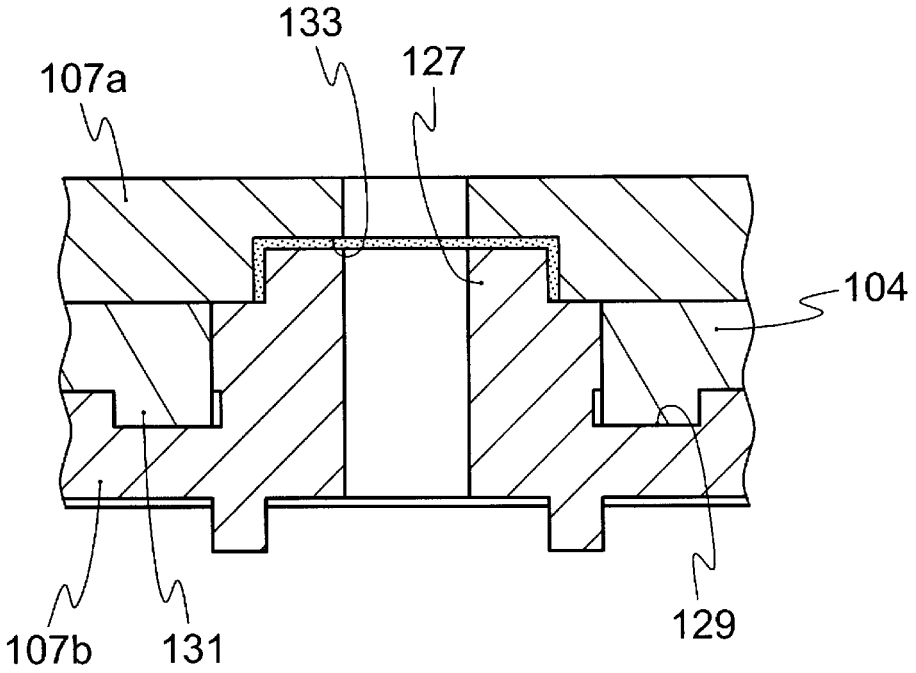
FIG. 11*b* is a cross-sectional view for explaining a state of the diaphragm and the center plates after ultrasonic welding shown in FIG. 11*a*.

Further, in the case of the aspect of the presently disclosed embodiment shown in FIG. 2, the rotation preventing protruded portions 27 on the edge of the opening of the diaphragm 4 are engaged with the rising portion 21 extending in a vertical direction from the surface of the second plate 7*b* constituting the center plates at the diaphragm 4 side, and when assembling the first and second plates 7*a* and 7*b* constituting the center plates to the diaphragm 4, the first and second plates 7*a* and 7*b* are in position to the diaphragm 4 and hardly rotate, thereby increasing work efficiency in assembling the center plates to the diaphragm 4. In addition, in a conventional diaphragm (See FIG. 7), protruded portions 131 (See FIG. 10) provided on the surface of the diaphragm 104 coming into contact with the second plate 107*b* of the center plates are fitted into the holes 129 formed on the surface of the second plate 107*b* of the center plate coming into contact with the diaphragm 104. As compared with such a conventional diaphragm, a contact surface area between the diaphragm 4 and the second plate 7*b* is larger, and therefore, a force of holding the first and second plates 7*a* and 7*b* constituting the center plates on the diaphragm 4 can be increased. As a result, the first and second plates 7*a* and 7*b* hardly slip out from the through-hole 26 of the diaphragm 4 and come off from the diaphragm 4.

In addition, while in this aspect, the first plate 7*a* is provided with the convex portions 25 and the center plate 7*b* is provided with the concave portions 20 and the rising portion 21, it is possible to configure such that the first plate 7*a* is provided with the concave portions 20 and the rising portion 21 and the second plate 7*b* is provided with the convex portions 25.

Further, though in this aspect, the number of convex portions 25 and concave portions 20 provided on the first plate 7*a* and the second plate 7*b*, respectively is plural (four), the above-mentioned effect can be obtained even in the case of plural numbers other than four. Furthermore, in this aspect, the number of rotation preventing protruded portions 27 to be provided on the through-hole 26 of the diaphragm 4 is plural (four), and the rising portion 21 of the second plate 7*b* is a cruciform corresponding to the cruciform through-hole 26 provided with the rotation preventing protruded portions 27. However, even if the number of rotation preventing protruded portions 27 is plural numbers other than four, the above-mentioned effect can be obtained by providing, on the second plate 7*b*, the rising portion 21 having a shape corresponding to the through-hole 26 provided with the rotation preventing protruded portions 27.

The results of experiments on the degree of pressing out of the diaphragm after compressing is explained below using FIGS. 12 to 14(*c*) by comparing Example using the diaphragm (hereinafter the diaphragm and center plate are referred to collectively as diaphragm block) sandwiched between the center plates in the electromagnetic vibrating diaphragm pump of the presently disclosed embodiment with Comparative Example using the diaphragm sandwiched between the center plates in the conventional electromagnetic vibrating diaphragm pump.

Figure 12:
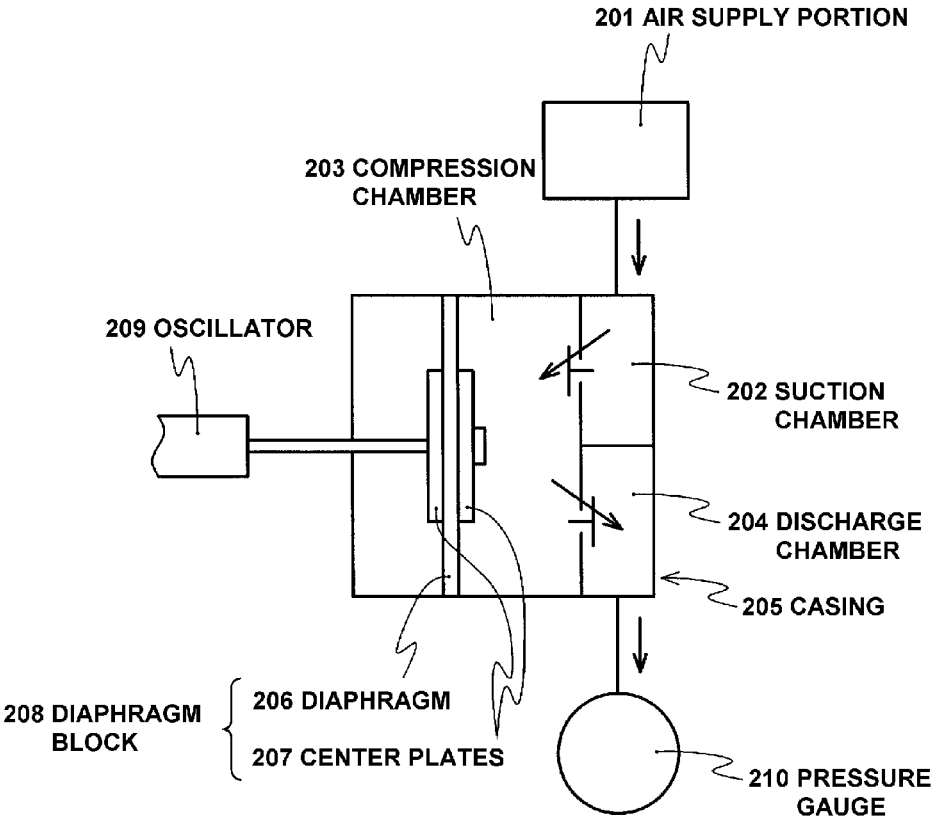
FIG. 12 is a schematic view for explaining a method of comparative experiments of Example of the invention of the instant application and Comparative Example.

FIG. 12 shows a schematic view for explaining a method of carrying out comparative experiments regarding pressing out of the diaphragm. This method of experiment according to the schematic view was applied to the both of Example and Comparative Example. First, a casing 205 for suction and discharging of air which was used on usual electromagnetic vibrating diaphragm pump was prepared, a diaphragm 206 was sandwiched between center plates 207, an oscillator 209 was mounted on the diaphragm 206, and the diaphragm 206 provided with the oscillator 209 and sandwiched between the center plates 207 was fixed to the casing 205. The casing 205 has a suction port for drawing air thereinto and a discharge port (not illustrated) and comprises a suction chamber 202, a compression chamber 203 and a discharge chamber 204. The compression chamber 203 is communicated with the suction chamber 202 and the discharge chamber 204 via valves. Air drawn in from the suction port flows through the suction chamber 202, the compression chamber 203 and the discharge chamber 204 in this order and is discharged from the discharge port. In this configuration, back-flow of air does not occur. Another end of the oscillator 209 which is not illustrated is not connected to other member such as a diaphragm.

In the diaphragm block 208 of Example, the diaphragm 4 and the center plates 7*a* and 7*b* of the embodiment shown in FIG. 1 were used as the diaphragm 206 and the two center plates 207, respectively. Further, in Comparative Example, the diaphragm block 208 comprising the diaphragm 104 and the center plates 107*a* and 107*b* shown in FIG. 7 were used, and jointing of the center plates 107*a* and 107*b* was carried out by ultrasonic welding. In both of Example and Comparative Example, the diaphragm 206 molded from EPDM (ethylene propylene rubber) and the center plates 207 molded from PBT (polybutylene terephthalate) were used. In addition, an outer diameter of the diaphragm 206 was the same both in Example and Comparative Example, and also, the conditions for mounting of the diaphragm on the casing 205 were the same.

Next, an air supply portion 201 was connected with the suction chamber 202 of the casing 205 and a pressure gauge 210 was connected with the discharge chamber 204. A distal end of the pressure gauge 210 was closed so that the pressure of air supplied from the air supply portion 201 was applied to the diaphragm 206.

Next, by carrying out air supply to the casing 205 and discharging of air as shown by arrows in FIG. 12, an air pressure of 120 kPa was applied to the diaphragm block 208 to deform the diaphragm 206 of the diaphragm block 208 toward the left side in FIG. 12, followed by maintaining this state for five seconds and then stopping air supply from the air supply portion. Thereafter, the diaphragm block 208 was taken out of the casing 205, and whether pressing out of the diaphragm 206 had occurred was observed.

Figure 13:
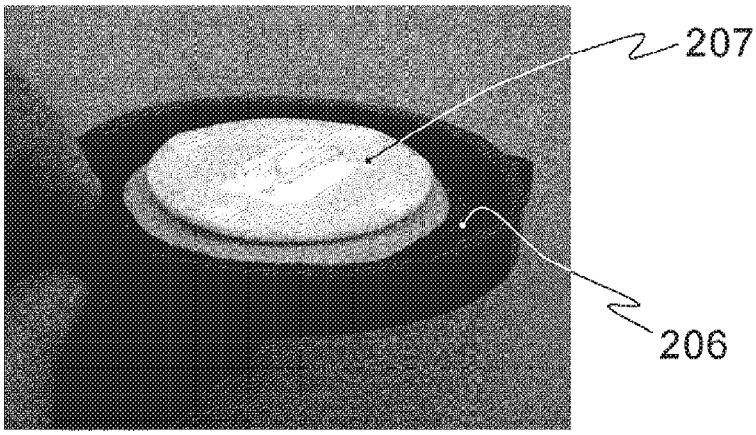
FIG. 13(*a*) is a photograph showing a surface of the diaphragm at the oscillator side of Example, (*b*) is a photograph showing a surface of the diaphragm at the compression chamber side of Example, and (*c*) is a photograph of the diaphragm of Example taken from its outer periphery side.
Figure 13:
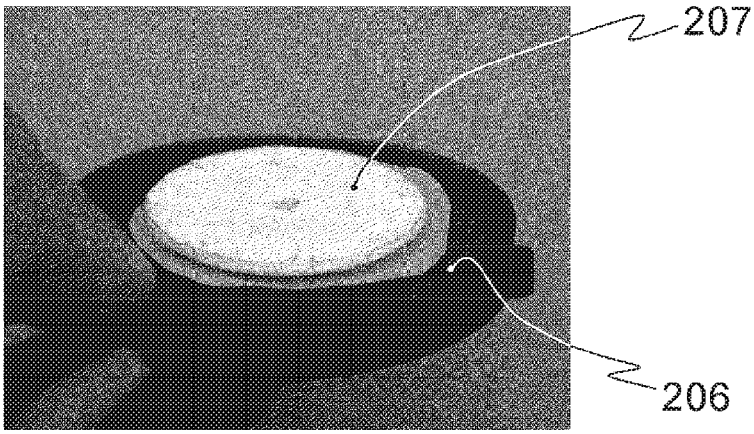
Figure 13:
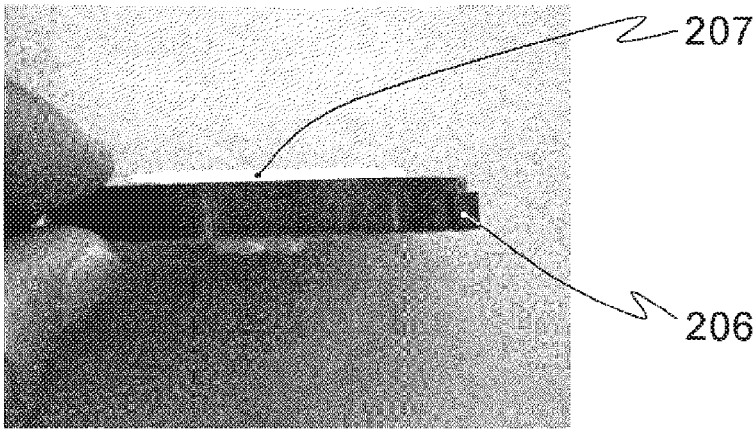
Figure 14:
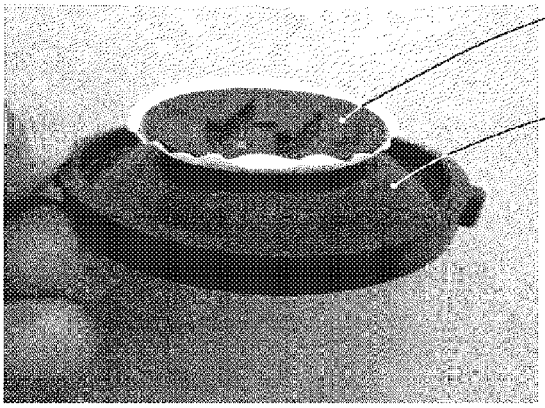
FIG. 14(*a*) is a photograph showing a surface of the diaphragm at the oscillator side of Comparative Example, (*b*) is a photograph showing a surface of the diaphragm at the compression chamber side of Comparative Example, and (*c*) is a photograph of the diaphragm of Comparative Example taken from its outer periphery side.
Figure 14:
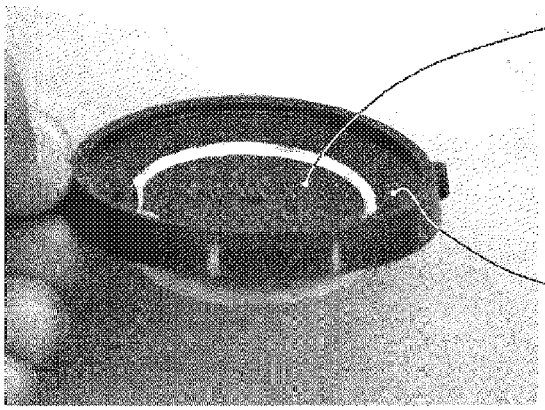
Figure 14:
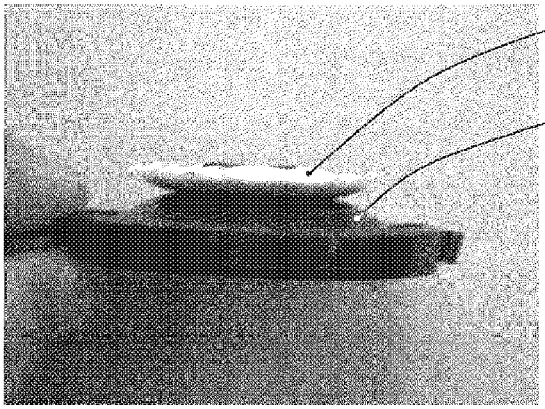

In Example according to the presently disclosed embodiment, no pressing out of the rubber of the diaphragm 206 from between the diaphragm 206 and the center plates 207 was found, and the diaphragm 206 returned to the original form after stopping the air supply from the air supply portion 201 as shown in FIG. 13(*a*) which is a photograph showing the surface of the diaphragm 206 at the oscillator 209 side in Example, FIG. 13(*b*) which is a photograph showing the surface of the diaphragm 206 at the compression chamber 203 side in Example, and FIG. 13(*c*) which is a photograph of the diaphragm 206 taken from its outer periphery side in Example. On the other hand, in Comparative Example, the diaphragm was subject to a stretching load in a direction toward its outer periphery side, and thereby, was pressed outside in a radial direction from between the center plate 207 and the surface of the diaphragm 206 at the oscillator 209 side as shown in the photograph of FIG. 14(*a*). The diaphragm 206 remained deformed after stopping the air supply from the air supply portion 201 (See FIGS. 14(*a*) to 14(*c*)). Namely, the deformation of Comparative Example in the surface of the diaphragm 206 at the oscillator 209 side was attributable to a distance between the ring rib 132 (See FIG. 7) of the center plate 207 and the raised portion 130 (See FIG. 10) of the diaphragm 206, and thereby the rubber between the raised portion 130 of the diaphragm 206 and the ring rib 132 of the center plate 207 got over the ring rib 132 of the center plate 207 and was pressed out toward the external side in a radial direction. Further, the pressed-out rubber acted to return to the original state after stopping the air supply from the air supply portion 201, but could not be restored because this restoring force was smaller than the holding force (a force contacting with the diaphragm 206) of the ring rib 132 of the center plate 207, and the diaphragm 206 was left deformed as shown in FIG. 14(*a*) which is a photograph showing the surface of the diaphragm 206 at the oscillator 209 side in Comparative Example and FIG. 14(*c*) which is a photograph of the diaphragm 206 taken from its outer periphery side in Comparative Example. Meanwhile, in Example, the ring ribs 29, 30 are engaged with the protrusions 28 for preventing the diaphragm from being pressed out from the outer periphery side of the protrusions, and there is no gap between them unlike Comparative Example, in which there is a gap (See FIG. 10) between the raised portion 130 and the ring rib 132 of the center plate 107*b*. Therefore, the rubber of the diaphragm 4 can be prevented from being pressed out and being left deformed.

From the results of the above-mentioned comparative experiments, it was found out that as compared with conventional products, an excellent function of preventing the diaphragm from being pressed out can be exhibited and deformation of the diaphragm due to pressing out of the rubber of the diaphragm can be prevented in the presently disclosed embodiment.

EXPLANATION OF SYMBOLS

1 Pump
2 2*a*, 2*b* Electromagnet
3 Oscillator
4 Diaphragm
4*a* Flange portion
7*a* First plate (Center plate)
7*b* Second plate (Center plate)
13 Electromagnetic core
14, 15 Electromagnetic coils
16, 17 Permanent magnets
18 Pump casing
20 Concave portion
21 Rising portion
22 Fitting groove
24 Fitting groove
25 Convex portion
26 Through-hole (Opening)
27 Rotation preventing protruded portion
28 Protrusion for preventing the diaphragm from being pressed out
29 Second ring rib
30 First ring rib
50*a*, 50*b*, 50*c* Partition walls
51 Suction chamber
52 Discharge chamber
53 Compression chamber
54 Suction valve
55 Discharge valve
56, 57 Vent holes
201 Air supply portion
202 Suction chamber
203 Compression chamber
204 Discharge chamber
205 Casing
206 Diaphragm
207 Center plate
208 Diaphragm block
209 Oscillator
210 Pressure gauge

What is claimed is:

1. An electromagnetic vibrating diaphragm pump for suction and discharging of a fluid by carrying out reciprocating vibration of an oscillator using a magnetic action and driving a pair of disc-like diaphragms provided at both ends of the oscillator, wherein each of the disc-like diaphragms is sandwiched from both sides thereof by center plates comprising a pair of disc-like plates, the center plates comprise a first plate having a plurality of convex portions formed on its surface coming into contact with the diaphragm and a second plate arranged opposite to the first plate and having a plurality of concave portions into which the convex portion are press-fitted, the convex portions of the first plate are press-fitted to the concave portions of the second plate through an opening formed at the center of the diaphragm, disc-like protrusions for preventing the diaphragm from being pressed out which protrude from both surfaces of the diaphragm are formed on the periphery of the opening of the diaphragm, and ring ribs engaging with the protrusions for preventing the diaphragm from being pressed out from the outer side in a radial direction of the diaphragm are formed on the first plate and the second plate respectively, wherein the first plate comprises a fitting groove for fitting the protrusion for preventing the diaphragm from being pressed out, the second plate comprises a fitting groove for fitting the protrusion for preventing the diaphragm from being pressed out, among the ring ribs, a first ring rib of the first plate side is formed so as to be raised along a margin of the fitting groove and is protruded higher than the surface of the first plate extending from the first ring rib outward in a radial direction of the first plate, and among the ring ribs, a second ring rib of the second plate side is formed so as to be raised along a margin of the fitting groove and is protruded higher than the surface of the second plate extending from the second ring rib outward in a radial direction of the second plate.

2. The electromagnetic vibrating diaphragm pump according to claim 1, wherein rotation-preventing protruded portions for preventing the center plates from rotating with respect to the diaphragm are formed on the edge of the opening of the diaphragm, the protruded portions being protruded toward the inner side in a radial direction of the diaphragm, and a rising portion extending in a vertical direction from the surface of the first plate or the second plate coming into contact with the diaphragm and having a shape corresponding to the opening having the rotation-preventing protruded portions formed thereon is formed on the first plate or the second plate, the rising portion being engaged with the rotation-preventing protruded portions.

* * * * *